US007159942B2

(12) United States Patent
Costaglia

(10) Patent No.: US 7,159,942 B2
(45) Date of Patent: Jan. 9, 2007

(54) SEAT SLIDE ADJUSTMENT MECHANISM

(75) Inventor: Massimo Costaglia, Santa Giustina in Colle (IT)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 11/210,299

(22) Filed: Aug. 24, 2005

(65) Prior Publication Data

US 2006/0071525 A1 Apr. 6, 2006

Related U.S. Application Data

(60) Provisional application No. 60/604,677, filed on Aug. 26, 2004.

(51) Int. Cl.
*B60N 2/02* (2006.01)

(52) U.S. Cl. ..... 297/311; 297/337

(58) Field of Classification Search ..... 297/337, 297/311, 353, 411.36; 248/424, 178.1
See application file for complete search history.

(56) References Cited

U.S. PATENT DOCUMENTS

| | | | |
|---|---|---|---|
| 134,627 | A | 1/1873 | Barney |
| 942,818 | A | 12/1909 | Flindall |
| 1,621,520 | A | 3/1927 | Snyder |
| 1,769,242 | A | 7/1930 | Toncray |
| 1,922,418 | A | 8/1933 | Conant |
| 1,987,851 | A | 1/1935 | Holman |
| 2,021,120 | A | 11/1935 | Wilkins |
| 2,446,185 | A | 8/1948 | Masucci et al. |
| 2,855,026 | A | 10/1958 | Simons et al. |
| 2,988,398 | A | 6/1961 | Hamilton |
| 3,090,647 | A | 5/1963 | Moore |
| 3,144,270 | A | 8/1964 | Bilancia |
| 3,235,308 | A | 2/1966 | Conner |
| 3,408,106 | A | 10/1968 | Bolling et al. |
| 3,511,533 | A | 5/1970 | Drabert |
| 3,526,430 | A | 9/1970 | Eldon |
| 3,785,700 | A | 1/1974 | Kubo |
| 3,821,845 | A | 7/1974 | Bailey |
| 3,982,785 | A | 9/1976 | Ambasz |
| 4,054,318 | A | 10/1977 | Costin |
| 4,084,850 | A | 4/1978 | Ambasz |
| 4,221,430 | A | 9/1980 | Frobose |
| 4,401,343 | A | 8/1983 | Schmidt |
| 4,491,366 | A | 1/1985 | Silber |
| 4,555,085 | A | 11/1985 | Bauer |
| 4,560,200 | A | 12/1985 | Giannelli et al. |
| 4,648,654 | A | 3/1987 | Voss |
| 4,648,656 | A | 3/1987 | Kimura |
| 4,687,251 | A | 8/1987 | Kazaoka et al. |
| 4,732,424 | A | 3/1988 | Uredat-Neuhoff |

(Continued)

*Primary Examiner*—Peter M. Cuomo
*Assistant Examiner*—Sarah B. McPartlin
(74) *Attorney, Agent, or Firm*—Shook, Hardy & Bacon L.L.P.

(57) ABSTRACT

A horizontal adjustment mechanism for use with a chair having a base, a seat supported on the base and a seat back. The mechanism includes a first plate that is to be coupled to the base and a second plate that is coupled to the seat. The second plate includes a mating portion. The second plate is slidably coupled to the first plate such that the second plate can move relative to the first plate. The mechanism also includes a lever mechanism. The lever mechanism includes a mating portion that selectively disengages from the mating portion of the second plate to allow the second plate to move relative to the first plate.

20 Claims, 7 Drawing Sheets

U.S. PATENT DOCUMENTS

| | | | | |
|---|---|---|---|---|
| 4,786,081 | A | 11/1988 | Schmidt | |
| 4,790,600 | A | 12/1988 | Behringer | |
| 4,796,951 | A | 1/1989 | Tamura et al. | |
| 4,981,326 | A | 1/1991 | Heidmann | |
| 5,035,466 | A | 7/1991 | Mathews et al. | |
| 5,048,893 | A | 9/1991 | Cowan et al. | |
| 5,171,062 | A | 12/1992 | Courtois | |
| 5,172,882 | A | 12/1992 | Nini | |
| 5,358,207 | A | 10/1994 | West | |
| 5,370,444 | A | 12/1994 | Stulik | |
| 5,390,978 | A | 2/1995 | Janisch | |
| 5,427,434 | A | 6/1995 | Hybarger | |
| 5,431,360 | A | 7/1995 | Yu | |
| 5,520,438 | A | 5/1996 | Stulik | |
| 5,531,168 | A | 7/1996 | Towfigh | |
| 5,582,460 | A | 12/1996 | Schultz | |
| 5,603,551 | A | 2/1997 | Sheehan | |
| 5,607,204 | A | 3/1997 | Gryp | |
| 5,660,442 | A | 8/1997 | Tornero | |
| 5,755,488 | A | 5/1998 | Beda et al. | |
| 5,755,490 | A | 5/1998 | Lamart | |
| 5,871,258 | A | 2/1999 | Battey et al. | |
| 5,884,887 | A | 3/1999 | Garelick et al. | |
| 5,909,923 | A | 6/1999 | DeKraker | |
| 5,947,559 | A | 9/1999 | Williams | |
| 5,961,088 | A | 10/1999 | Chabanne et al. | |
| 6,000,756 | A | 12/1999 | Hybarger et al. | |
| 6,010,189 | A | 1/2000 | Hybarger et al. | |
| 6,010,194 | A | 1/2000 | Cykon | |
| 6,027,168 | A | 2/2000 | Crossman | |
| 6,135,556 | A | 10/2000 | Chu | |
| 6,139,103 | A | 10/2000 | Hybarger et al. | |
| 6,892,995 | B1 * | 5/2005 | Tame et al. | 248/429 |
| 6,976,739 | B1 * | 12/2005 | Wang | 297/411.35 |
| 6,986,550 | B1 * | 1/2006 | Gevaert et al. | 297/337 |
| 6,994,400 | B1 * | 2/2006 | Koepke et al. | 297/337 |
| 2005/0082888 | A1 * | 4/2005 | Williams et al. | 297/250.1 |

* cited by examiner

SEAT SLIDE ADJUSTMENT MECHANISM

CROSS-REFERENCE TO RELATED APPLICATIONS

This application claims the benefit of U.S. Provisional Application No. 60/604,677, filed Aug. 26, 2004.

STATEMENT REGARDING FEDERALLY SPONSORED RESEARCH OR DEVELOPMENT

Not applicable.

BACKGROUND OF THE INVENTION

This invention relates generally to chair-control mechanisms, and more particularly to a mechanism that allows the horizontal fore-to-aft position of a chair seat to be adjusted relative to the seat back thereof.

Typical office chairs and the like are generally provided with an adjustment mechanism for permitting horizontal fore-to-aft adjustment of a seat. Some mechanisms are self-adjusting when the user shifts his or her weight. These designs contain detent and notch arrangements that prevent movement when the user is seated and allow movement when the user removes his or her weight from the seat. These configurations suffer from a number of drawbacks. For instance, the user must stand to adjust the seat. Further, chairs having this arrangement permit a substantial amount of side-to-side movement.

Another type of mechanism generally includes guide channels or tracks attached to the seat or base. The channels or tracks contain bearing members, such as depending rods or runners, that permit horizontal fore-to-aft movement of the seat relative to the seat back. However, these mechanisms are often bulky and increase the overall height of the seat such that it cannot be adjusted low enough to the ground to accommodate those in the lower height percentiles of the population. Accordingly, there remains a need in the adjustable chair industry for a horizontal adjustment mechanism which is relatively simple and inexpensive to manufacture and assemble and that only minimally changes the height of the chair seat.

Thus, while horizontal fore-to-aft adjustment mechanisms are known in art, it would be desirable to provide an adjustment mechanism for a chair, wherein the mechanism can be employed between a conventional seat and a tilt control mechanism that has a relatively low profile which does not significantly increase the overall height of the seat relative to the ground.

SUMMARY OF THE INVENTION

Accordingly, the present invention provides an adjustment assembly that allows the seat depth on a chair to be varied throughout a range of motion. The assembly utilizes a first plate that is coupled to the tilt control mechanism which is coupled to the chair base. A second plate is affixed to the chair seat, which is allowed to selectively slide relative to the first plate. A selected number of seat depth positions are available. The user can adjust the seat depth by operation of a paddle arm. This operation disengages a series of teeth on a pawl from a series of teeth located on a rack in the second plate. When disengaged, the second plate and seat are allowed to move with respect to the first plate and tilt control mechanism. Once in the desired position, the paddle can be operated to re-engage the teeth of the pawl with the teeth of the rack to hold the seat in the new position.

Additional advantages, and novel features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
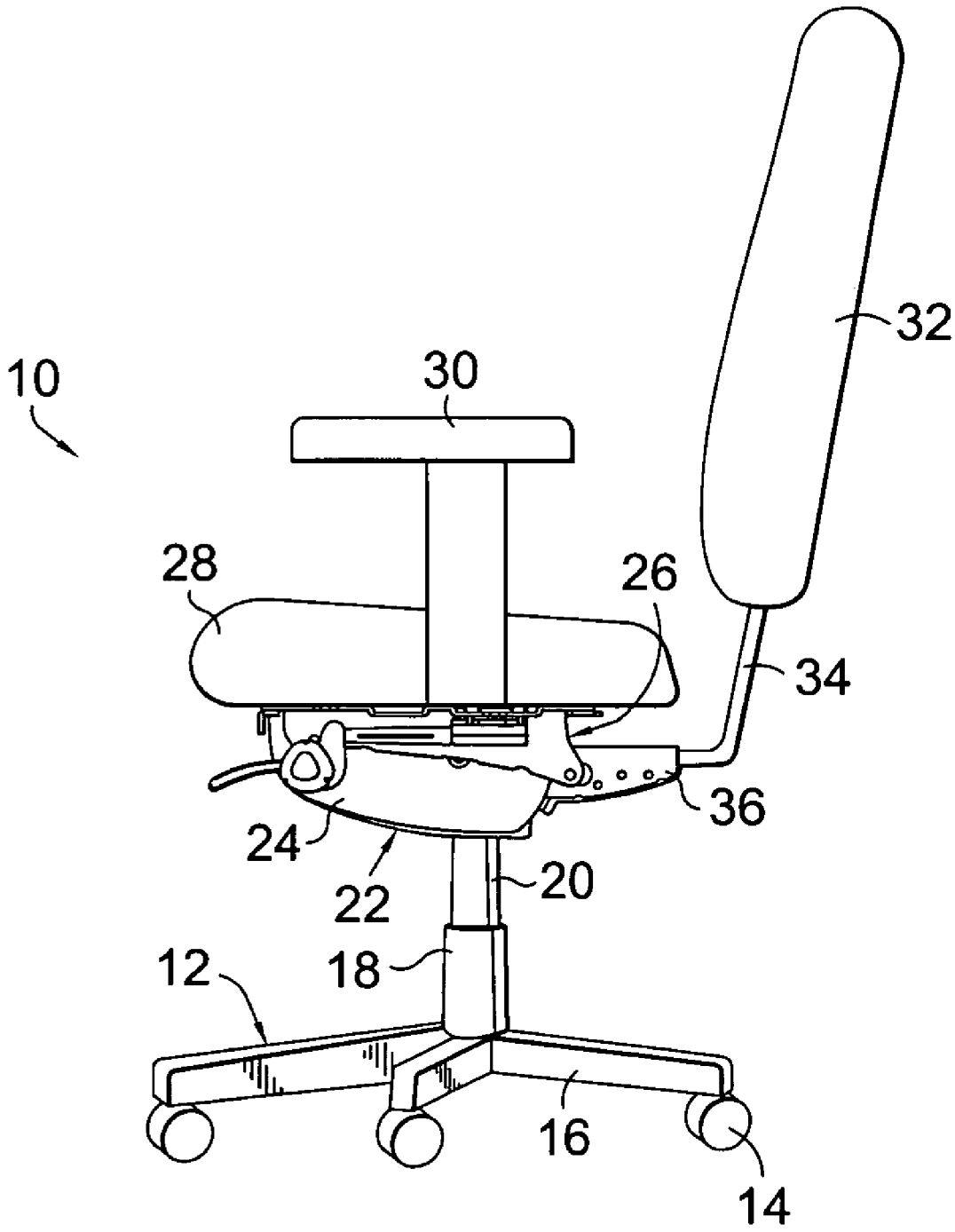
FIG. 1 is a perspective view of the seat slider attached to a tilt control mechanism.

With initial reference to FIG. 1, a chair embodying the principles of the invention is generally indicated by reference numeral 10. The chair 10 is equipped with a base assembly 12. The base 12 preferably has a number of castors 14 operably supported on the outer ends of a corresponding number of support legs 16. The support legs 16 converge to a pedestal column 18. Preferably, the pedestal column 18 and the support legs 16 are integrally formed in one piece. The column 18 preferably supports a gas cylinder 20. As is known to those of skill in the art, the gas cylinder 20 allows the height of the chair to be adjusted by an occupant. The construction of the base 12 and column 18 is well known to those of skill in the chair industry.

Figure 2:
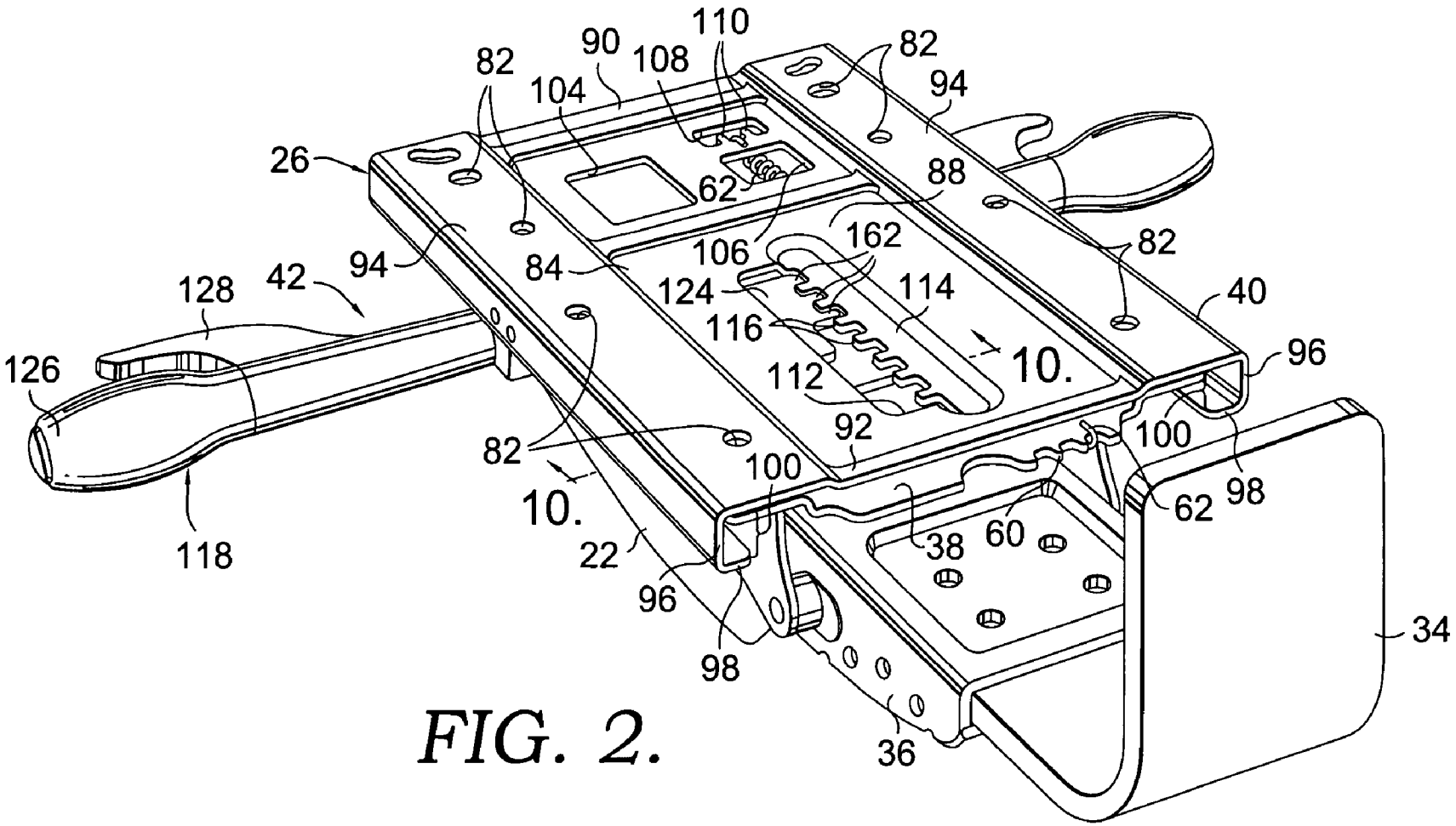
FIG. 2 is a side view similar to FIG. 1.

Referring now to FIGS. 1 and 2, a tilt control mechanism 22 is shown coupled to the gas cylinder 20. It is understood by one of ordinary skill in the art that the tilt control mechanism 22 contains a housing 24 and various internal parts that control the tilt of the chair. The tilt control mechanism 22 supports a seat-depth adjustment mechanism 26. Specifically, the seat 28 is coupled to the seat-depth adjustment mechanism 26 which is, in turn, coupled to the tilt control mechanism 22. The tilt control mechanism 22 includes a hole in its bottom, not shown, that accommodates an upper portion of gas cylinder 20. The upper portion of cylinder 20 is then secured to tilt control mechanism 22 so that as the cylinder 20 extends and retracts, the tilt control mechanism 22 correspondingly moves up and down. Preferably, this coupling is accomplished via a tapered bushing, as is known to those of skill in the art. A pair of armrests 30 and a chair back 32 are also coupled to the tilt control mechanism 22. Coupling of the chair back 32 to the tilt control mechanism 22 is accomplished by a J-back support bar 34 and a J-back adjustment assembly 36.

Referring again to FIGS. 1 and 2, the seat-depth adjustment mechanism 26 will be discussed. The seat-depth adjustment mechanism 26 is affixed to the tilt control mechanism 22. The tilt control mechanism 22 typically operationally couples the base 12, the seat 28, and the back 32, as known to those of skill in the art. The seat-depth adjustment mechanism 26 includes a first plate 38, a second plate 40, and a lever mechanism 42. The second plate 40 is slidingly coupled to the first plate 38 which is in turn coupled to the tilt control mechanism 22 as is further discussed below.

Figure 3:
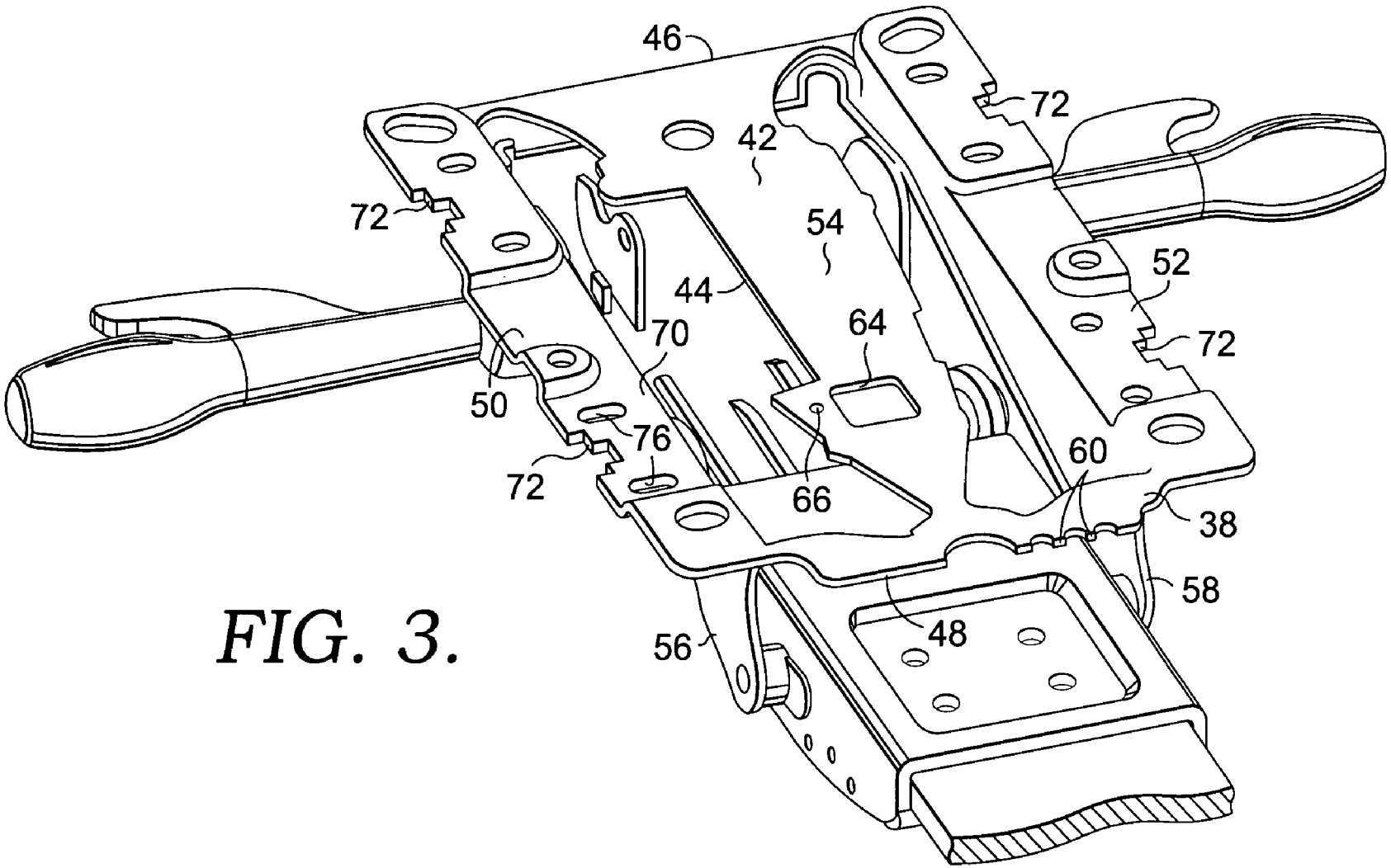
FIG. 3 is a partial perspective view taken from underneath the seat slider.
Figure 6:
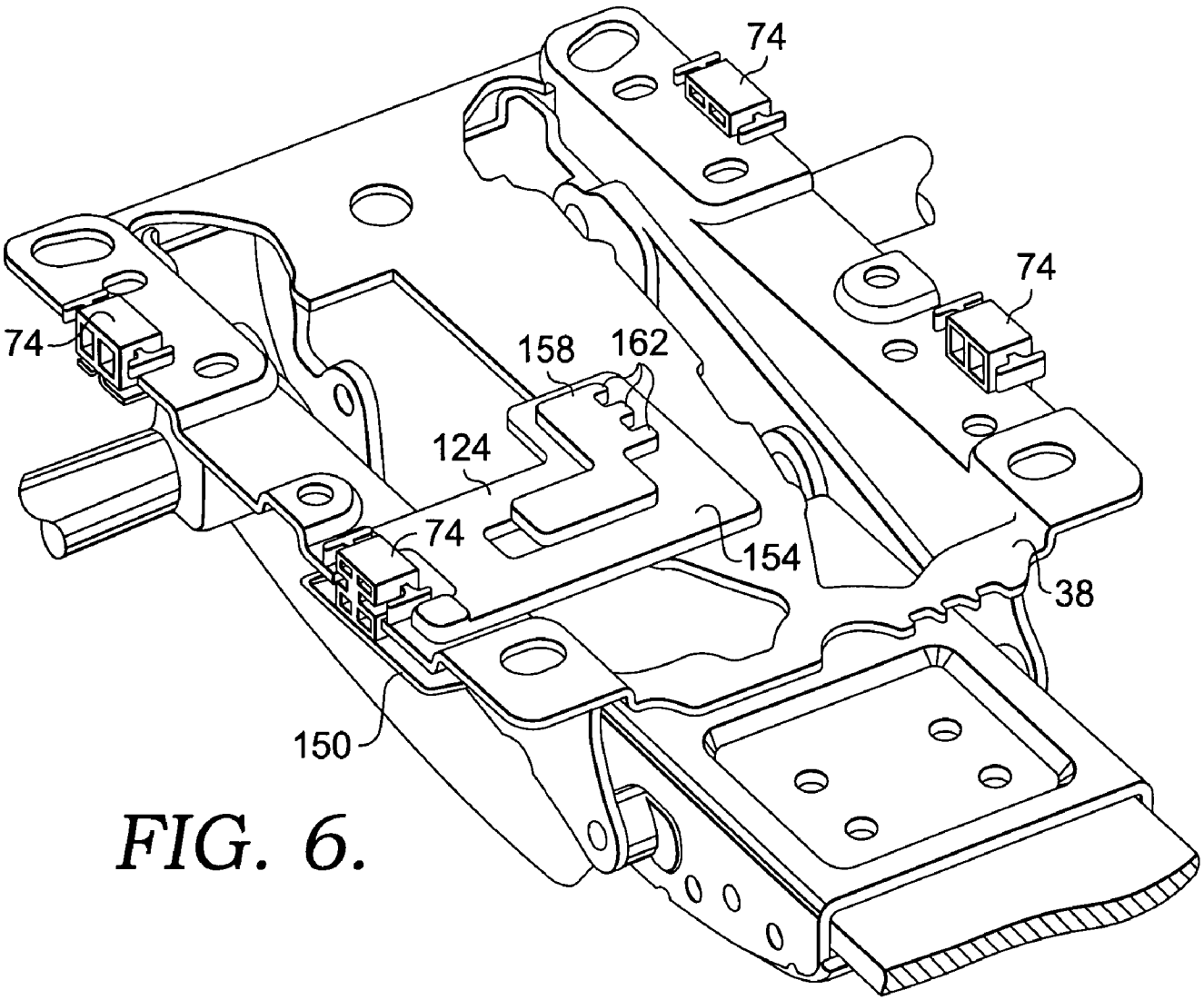
FIG. 6 is a generally front view showing the guide blocks.

Referring now to FIG. 3, the first plate 38 will be discussed. The first plate 38 is generally planar, presenting top and bottom surfaces 42, 44, front 46, rear 48 and side edges 50, 52, a central portion 54, and a pair of sidewalls 56, 58. The first plate 38 is preferably made from stamped steel, although any suitable material may be used. The rear edge 48 contains a plurality of projections 60 used to couple a spring 62, shown in FIG. 2, to the second plate 40, as will be further discussed below. The central portion 54 contains a generally rectangular opening 64 and an aperture 66. The rectangular opening 64 receives a portion of the lever mechanism 42, while the aperture 66 is used to couple a spring 68, shown in FIG. 10, to a portion of the lever mechanism 42, the importance of each will be further discussed below. Each of the sidewalls 56, 58 is formed from a separate cutout of the central portion 54 and depend downwardly therefrom, thereby providing a pair of openings located between the side edges 50, 52. The side edges 50, 52 depend outwardly from the central portion 54 and are connected thereto by the front and rear edges 46, 48. Each of the side edges 50, 52 is partially stepped to present a raised profile portion. The side edges 50, 52 further include a surface 70 that is aligned in the same plane as the central portion 54. The side edges 50, 52 are used to slidingly couple the first plate 38 to the second plate 40 as will be further discussed below. Each of the side edges 50, 52 further contains a pair of recesses 72. As shown in FIGS. 3 and 6, each of the recesses 72 receives a guide block 74 that facilities sliding movement between the second plate 40 and the first plate 38. Specifically, the guide blocks 74 are placed within the recesses 72 to provide a layer of material between the first plate 38 and the second plate 40 to facilitate movement therebetween. While any suitable material for the guide blocks 74 may be used, the guide blocks 74 are preferably made from a durable, low-friction material such as polyethylene, polypropylene, or nylon that facilitates the sliding action of the top plate. Side edge 50 also contains a pair of elongated slots 76 that receive a portion of the lever mechanism 42 as will be further discussed below.

Figure 4:
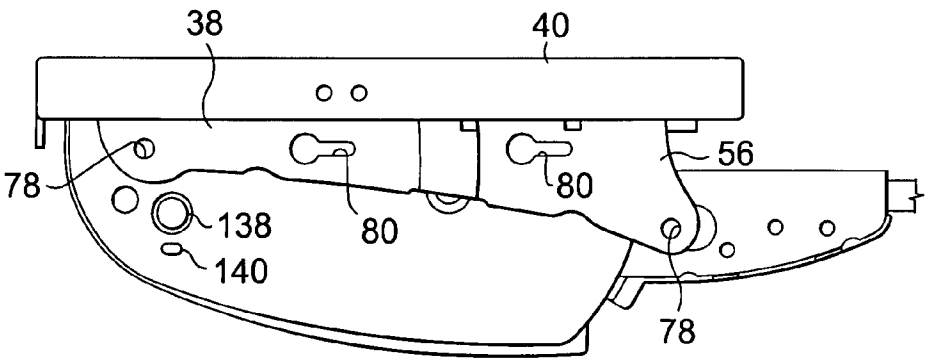
FIG. 4 is a view similar to FIG. 3.

As seen in FIGS. 3 and 4, the sidewalls 56, 58 depend downwardly from the central portion 54 and contain a pair of apertures 78 used to couple the first plate 38 to the tilt control mechanism 22. Sidewall 56 further contains a pair of keyhole apertures 80 that are used to couple a portion of the lever mechanism 42, shown in FIGS. 5 and 7, as will be further discussed below.

Figure 10:
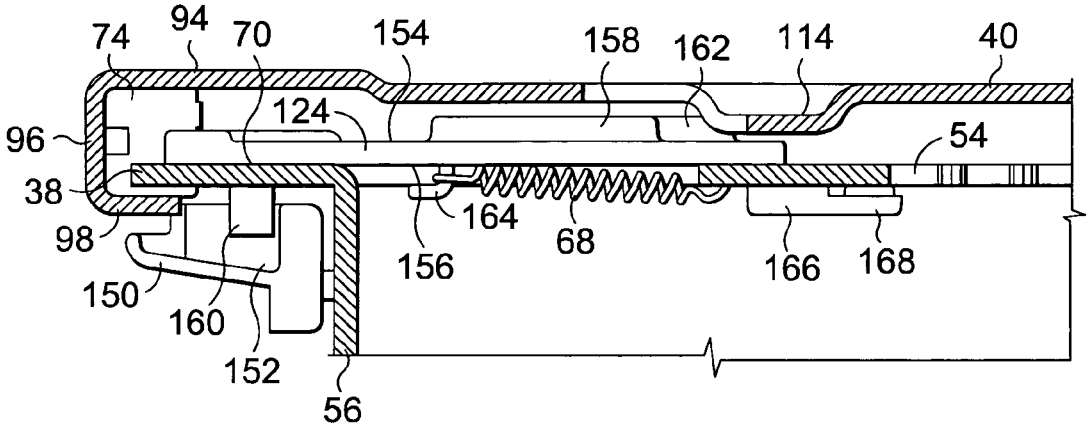

The second plate 40 is illustrated in FIG. 2 and includes a plurality of mounting holes 82 near the perimeter thereof which facilitate fastening the plate 40 to the bottom of the seat 28. The second plate 40 is preferably made from stamped steel, although any suitable material may be used. The second plate 40 is generally planar, presenting top and bottom surfaces 84, 86, a central portion 88, and front, rear and side edges 90, 92, 94. As is best seen in FIG. 4, each of the side edges 94 is stepped to present a raised profile portion in which the mounting holes 82 are formed for receiving fasteners to attach the second plate 40 to the seat 28. The raised profile portions are raised above the central portion 88 of second plate 40. The raised profile portions further include a downward protrusion 96. The downward protrusion 96 contains an inwardly projecting portion 98 that creates a C-shaped cross section 100. Specifically, as shown in FIGS. 2, 6, and 10, the C-shaped cross-section 100 receives the guide blocks 74 on the first plate 38. Specifically, as stated above, the guide blocks 74 are placed in the recesses 72 of the first plate 38 and then are positioned within the C-shaped cross section 100 of the second plate 40. Thus, the guide blocks 74 provide a layer of material between the first plate 38 and the second plate 40 to facilitate movement therebetween. The second plate 40 also contains a pair of stops 102 located at a rearward portion of the C-shaped cross-section 100. The stops 102 serve to limit the overall travel of the second plate 40 with respect to the first plate 38.

Referring again to FIG. 2, the mounting holes 82 are preferably arranged in a pattern corresponding to that of the mounting holes of the seat 28 such that the seat-depth adjustment mechanism 26 may be mounted to the seat 28 without requiring modification. As such, the seat-depth adjustment mechanism 26 can be offered in combination with any conventional chair, including or not including a tilt control mechanism, to permit fore-to-aft adjustment of the chair seat relative to the seat back. Preferably, multiple sets of mounting holes 82 are formed in the second plate 40 so that the seat 28 may be assembled on the seat-depth adjustment mechanism 26 in multiple fore-to-aft positions. However, it is possible to form the plate 40 with only a single set of mounting holes 82 if desired.

The central portion 88 contains a pair of generally rectangular openings 104, 106 and an M-shaped opening 108 with a plurality of projections 110 located proximate the front edge 90. The projections 110 serve to attach the spring 62 connected to the projections 60 of first plate 38 to bias the second plate 40 with respect to the first plate 38. The central portion 88 also contains an opening 112 and a lowered profile rack 114 that is oriented in parallel with the line of motion of the second plate 40. The opening 112 is generally rectangular, formed adjacent the rack 114 and allows for mating with a portion of the lever mechanism 42. The rack 114 is shaped as shown and contains a plurality of teeth 116. Additionally, the length of rack 114, and the number of teeth 116 therein, is determined by the number of discrete positions desired by the manufacturer of the seat-depth adjustment assembly 26. For example, as shown in FIG. 2, the rack 114 can be of a length allowing six discrete positions.

Figure 5:
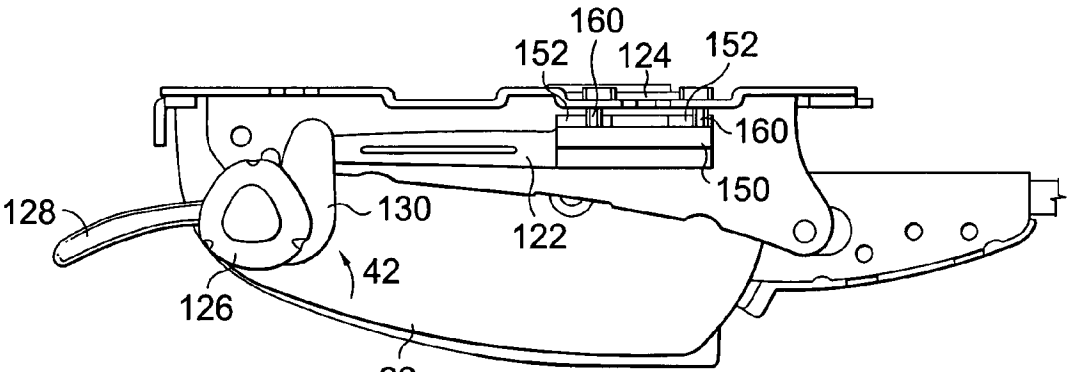
FIG. 5 is a view showing the top plate.
Figure 7:
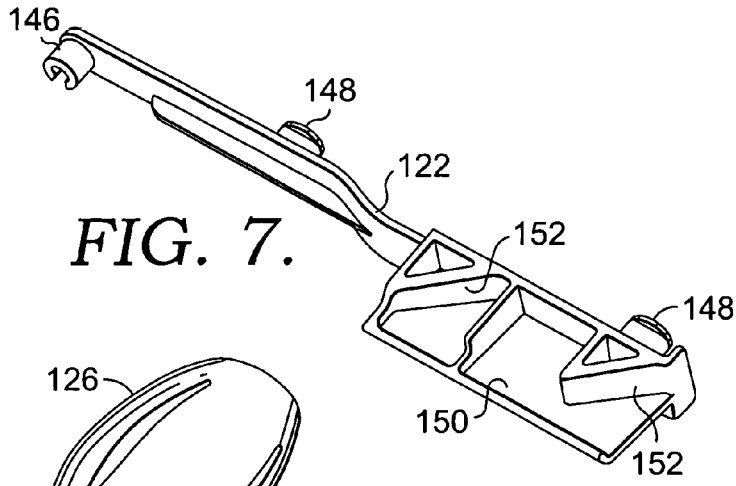
FIG. 7 is a partial perspective view showing the forward and rearward stops.
Figure 8:
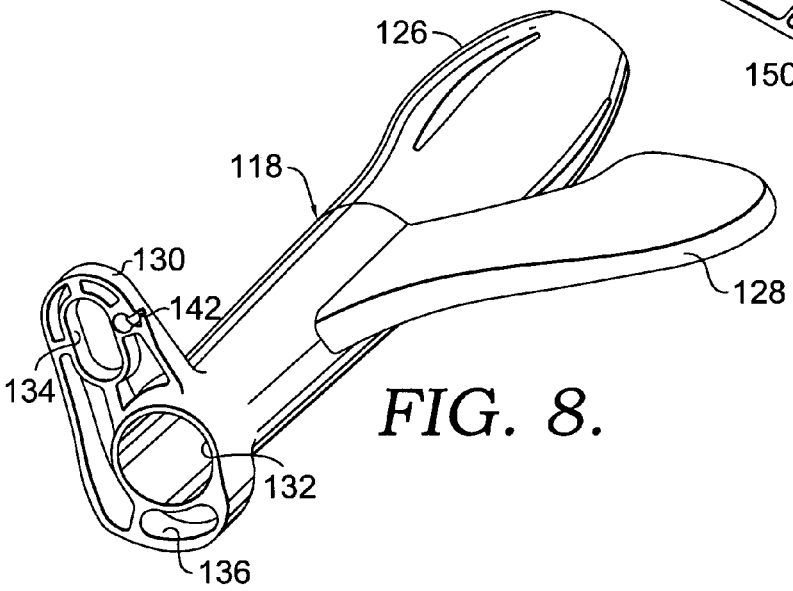

As shown in FIGS. 2 and 5, the lever mechanism 42 includes a lever arm 118, a shaft 120, not shown, a cam linkage 122, and a pawl 124. Each of the components of the lever mechanism 42 is preferably made from molded plastic, however, any suitable material may be used. The lever arm 118 is fixedly coupled to the shaft 120 which is rotatably mounted to the tilt control mechanism 22. As shown in FIGS. 2, 5, and 8, the lever arm 118 contains a handle 126, a paddle arm 128, and an actuator 130, the handle 126 being fixedly coupled to the shaft 120. The paddle arm 128 and actuator 130 are integral and rotatably coupled to the handle 126 such that movement of paddle arm 128 does not move the handle 126. The actuator 130 is shaped as shown and has an enlarged aperture 132, an elongated aperture 134, and an elongated slot 136. As shown in FIGS. 4, 5 and 7, the actuator 130 is mounted to a cylindrical protrusion 138 located on the tilt control mechanism 22 via the enlarged aperture 132. The elongated slot 136 receives a projection 140 located on the tilt control mechanism 22 and controls the rotation of the paddle arm 128.

Turning now to FIGS. 5 and 7, the cam linkage 122 will be discussed. The cam linkage 122 contains a projecting pin 146, a pair of flanged protrusions 148, and a cam plate 150. The projecting pin 146 is located proximate a front portion of the cam linkage 122. The projecting pin 146 is received in the elongated aperture 134 of the actuator 130, shown in FIG. 8, and allows for movement of the cam linkage 122 when the paddle arm 128 is rotated. Specifically as the paddle arm 128 is rotated the cam linkage 122 moves rearwardly. The flanged protrusions 148 project inwardly from the cam linkage 122 and are received within the keyhole apertures 80 in the first plate 38, shown in FIG. 4. Thus, the flanged protrusions 148, along with the keyhole apertures 80 slidingly couple the cam linkage 122 of the lever mechanism 42 to the first plate 38. The cam plate 150 is located at a rear portion of the cam linkage 122. The cam plate 150 contains a pair of upwardly extending inclined cam surfaces 152. The cam surfaces 152 are adapted to abut a portion of the pawl 124.

Figure 9:
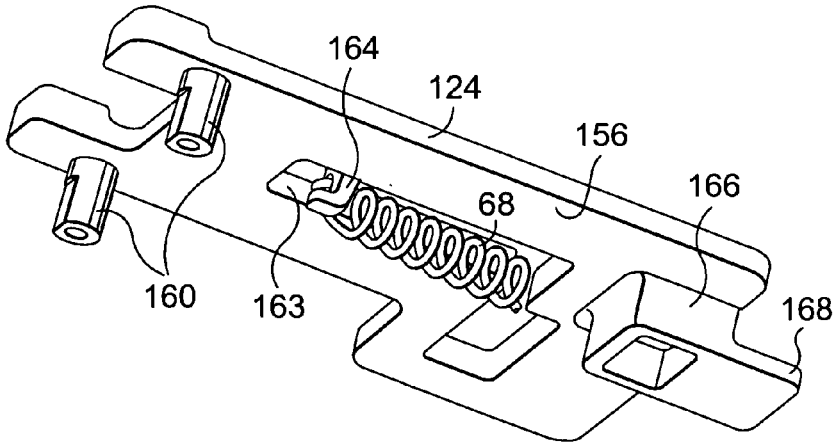

Referring now to FIGS. 6, 9, and 10, the pawl 124 will be discussed. The pawl 124 is shaped as shown and includes an upper and lower surface 154, 156, a raised portion 158, and a pair of cam pins 160. The lower surface 156 of the pawl 124 rests on the surface 70 and the central portion 54 of the first plate 38. The raised portion 158 is shaped as shown and contains a plurality of teeth 162. The teeth 162 are designed to mate with the teeth 116 on the rack 114, as shown in FIG. 2. The cam pins 160 project downwardly from the lower surface 156 through the elongated slots 76 of the first plate 38, shown in FIG. 3. The cam pins 160 then mate with the inclined cam surfaces 152, shown in FIGS. 5 and 7, such that when the paddle arm 128 is turned the pawl 124 engages and disengages from the rack 114, shown in FIG. 2, as will be further discussed below.

As shown in FIGS. 9 and 10, the pawl 124 further includes a rectangular opening 163 and a hook-like projection 164 depending downwardly from the lower surface 156 adjacent the opening 163. The projection 164 attaches to a first end of the spring 68, the spring 68 having a second end for attaching to the aperture 66 located in the first plate 38, shown in FIG. 3. The spring 68 biases the teeth 162 of the pawl 124 into contact with the teeth 116 of the rack 114, shown in FIG. 2.

The pawl 124 also includes a downwardly projecting block 166 with a tab 168 attached thereto. The tab 168 is flat and projects inwardly from the block 166. The tab 168 and block 166 are received in the rectangular opening 64 in the central portion 54 of the first plate 38, shown in FIG. 3. As stated above, the lower surface 156 rests on the surface 70 of side edge 50 and the central portion 54 of the first plate. Thus, the block 166 and rectangular opening 64 along with the surface 70 and central portion 54 support and guide the pawl 124 as it engages and disengages from the rack 114.

Referring now to FIGS. 2, 5, and 10, the operation of the seat-depth adjustment mechanism 26 will be discussed. Initially, the pawl 124 is in engagement with the rack 114. The spring 68 biases the teeth 162 of the pawl 124 into engagement with the teeth 116 of the rack 114. In this position, the cam pins 160 are located at an inner portion of the elongated slots 76. When paddle arm 128 is rotated, the actuator 130 attached thereto, also rotates. The rotational movement of the actuator 130 is translated into longitudinal movement of the cam linkage 122. As the cam linkage 122 moves forward, the inclined cam surfaces 152 move forward as well, thereby guiding the cam pins 160 outwardly within the slots 76 in the first plate 38. As the cam pins 160 move outwardly, teeth 162 of the pawl 124 disengages from the teeth 116 of the rack 114. In the disengaged position, the second plate 40 and, thus, the chair seat 28, are allowed to move with respect to the first plate 38. As such, the depth of the seat 28 with respect to the base 12 and chair back 32 may be adjusted. Once in a desired position, the paddle arm 128 is released the spring 62 biases the teeth 162 of the pawl 124 back into engagement with the teeth 116 of the rack 114 to hold the seat 28 in position.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A horizontal adjustment mechanism for use with a chair having a base, a seat supported on the base and defining a fore-to-aft longitudinal axis, and a seat back, the mechanism comprising:

a first plate adapted to be coupled to the base;

a second plate adapted to be coupled to the seat, the second plate having a mating portion and being slidably coupled to the first plate such that the second plate can move relative to the first plate along the longitudinal axis of the seat; and a lever mechanism rotatably coupled to the first plate, said lever mechanism having a lever arm, a cam linkage rotatably coupled to the lever arm and slidingly coupled to the first plate, and a mating portion adapted to be releasably received in the mating portion of the second plate, wherein rotation of the lever arm translates into linear movement of the cam linkage in a direction generally parallel with the longitudinal axis of the seat to selectively disengage the mating portion of the lever mechanism from the mating portion of the second plate to allow the second plate to move relative to the first plate.

2. The adjustment mechanism as recited in claim 1, wherein the mating portion of the lever mechanism includes at least one downwardly protruding member.

3. The adjustment mechanism as recited in claim 2, wherein the cam linkage includes a cam surface, the cam surface being adapted to engage the downwardly protruding member to selectively disengage the mating portion of the lever mechanism with the mating portion of the second plate.

4. The adjustment mechanism as recited in claim 3, wherein the at least one downwardly protruding member includes a pair of downwardly protruding members.

5. The adjustment mechanism as recited in claim 4, wherein the cam surface includes a pair of cam surfaces.

6. The adjustment mechanism as recited in claim 5, wherein the mating portion of the second plate includes an opening and a rack having at least one notch adjacent the opening.

7. The adjustment mechanism as recited in claim 6, wherein the mating portion of the lever mechanism includes a raised portion with at least one projection.

8. The adjustment mechanism as recited in claim 7, wherein the raised portion includes a plurality of projections.

9. The adjustment mechanism as recited in claim 8, wherein at least one notch includes a plurality of notches.

10. The adjustment mechanism as recited in claim 9, wherein the mating portion of the lever mechanism includes a downwardly depending block member, the block member being adapted to slidably engage an aperture located in the first plate, whereby the member and aperture guide the mating portion.

11. The adjustment mechanism as recited in claim 10, wherein the mating portion of the lever mechanism is biased into engagement with the mating portion of the first plate by a spring.

12. The adjustment mechanism as recited in claim 11, wherein an intermediate element is positioned between said first and second plates for facilitating relative sliding movement therebetween.

13. An adjustment mechanism for use in a chair having a seat defining a fore-to-aft longitudinal axis, a base on which the seat is supported, a seat back, and a tilt control mechanism which allows the seat to be tilted relative to the base, the mechanism comprising:

a first plate adapted to be coupled to the tilt control mechanism;

a second plate adapted to be coupled to a bottom surface of the seat, the second plate being slidably coupled to said first plate such that said first and second plates can move relative to one another along the longitudinal axis of the seat and the second plate having a centrally located mating portion including an opening with a plurality of notches; and a lever mechanism rotatably coupled to the first plate, said lever mechanism having a lever arm, a cam linkage rotatably coupled to the lever arm and slidingly coupled to the first plate, and a mating portion having a raised portion with a plurality of projections, the plurality of projections being adapted to be releasably received in the plurality of notches, wherein rotation of the lever arm translates into linear movement of the cam linkage in a direction generally parallel with the longitudinal axis of the seat to selectively disengage the projections from the notches to allow the second plate to move relative to the first plate.

14. The adjustment mechanism as recited in claim 13, wherein the mating portion of the lever mechanism includes at least one downwardly protruding member.

15. The adjustment mechanism as recited in claim 14, wherein the cam linkage includes a cam surface, the cam surface being adapted to engage the downwardly protruding member to selectively disengage the mating portion of the lever mechanism with the mating portion of the second plate.

16. The adjustment mechanism as recited in claim 15, wherein the at least one downwardly protruding member includes a pair of downwardly protruding members.

17. The adjustment mechanism as recited in claim 15, wherein the cam surface includes a pair of cam surfaces.

18. The adjustment mechanism as recited in claim 17, wherein the mating portion of the lever mechanism is biased into engagement with the mating portion of the first plate by a spring.

19. The adjustment mechanism as recited in claim 18, wherein the mating portion of the lever mechanism includes a downwardly depending block member, the block member being adapted to slidably engage an aperture located in the first plate, whereby the member and aperture guide the mating portion.

20. The adjustment mechanism as recited in claim 19, wherein an intermediate element is positioned between said first and second plates for facilitating relative sliding movement therebetween.

* * * * *